US009818531B2

(12) United States Patent
Oki

(10) Patent No.: US 9,818,531 B2
(45) Date of Patent: Nov. 14, 2017

(54) METHOD OF MAGNETIC CORE

(71) Applicant: Sumida Corporation, Chuo-ku, Tokyo (JP)

(72) Inventor: Juichi Oki, Tokyo (JP)

(73) Assignee: SUMIDA CORPORATION, Tokyo (JP)

( * ) Notice: Subject to any disclaimer, the term of this patent is extended or adjusted under 35 U.S.C. 154(b) by 248 days.

(21) Appl. No.: 14/716,067

(22) Filed: May 19, 2015

(65) Prior Publication Data

US 2015/0248967 A1 Sep. 3, 2015

Related U.S. Application Data

(62) Division of application No. 14/025,371, filed on Sep. 12, 2013, now Pat. No. 9,064,629.

(30) Foreign Application Priority Data

Sep. 12, 2012 (JP) ..... 2012-200091

(51) Int. Cl.
*H01F 7/06* (2006.01)
*H01F 41/02* (2006.01)
(Continued)

(52) U.S. Cl.
CPC ..... *H01F 41/0206* (2013.01); *H01F 3/08* (2013.01); *H01F 27/29* (2013.01); *Y10T 29/4902* (2015.01)

(58) Field of Classification Search
CPC ..... H01F 3/08; H01F 27/29; H01F 27/365; H01F 38/14; H01F 2027/348; H02J 5/005; H02J 7/025; H05K 9/0075
See application file for complete search history.

(56) References Cited

U.S. PATENT DOCUMENTS 6,710,693 B2 * 3/2004 Matsumoto ..... H01F 3/10 336/110
7,071,803 B2 7/2006 Oki
(Continued)

FOREIGN PATENT DOCUMENTS

CN 1577650 A 2/2005
CN 101325116 A 12/2008
(Continued)

OTHER PUBLICATIONS

Chinese Office Action corresponding to Application No. 201310254696.6; dated Oct. 9, 2015, with English summary.

*Primary Examiner* — Paul D Kim
(74) *Attorney, Agent, or Firm* — Cantor Colburn LLP

(57) ABSTRACT

A magnetic core including a winding core portion; and a flange portion provided on the axial end side of at least one of the winding core portion, wherein the flange portion is formed such that contour line OL1 of cross-section P, of the flange portion, which becomes perpendicular with respect to the axis line of the winding core portion forms a shape of a first irregular convex polygon which is substantially a non-regular polygon and also a convex polygon, and the contour line OL1 contacts with respect to all of sides Sb1, Sb2, Sb3 and Sb4 which are the four sides of a first circumscribed rectangle which becomes minimum within imaginary rectangles circumscribed with the contour line OL1 and also, the contour line OL1 includes side Sa1 and side Sa2 which respectively overlap with portions of respective ones of the side Sb1 and the side Sb2.

1 Claim, 8 Drawing Sheets

(51) Int. Cl.
*H01F 27/29* (2006.01)
*H01F 3/08* (2006.01)

(56) References Cited

U.S. PATENT DOCUMENTS

| | | | | |
|---|---|---|---|---|
| 7,463,130 | B2 | 12/2008 | Oki | |
| 7,515,028 | B1 | 4/2009 | Sato et al. | |
| 7,843,301 | B2 * | 11/2010 | Shoji | H01F 17/045 336/192 |
| 7,898,375 | B2 * | 3/2011 | Kitajima | H01F 17/045 336/185 |
| 8,013,704 | B2 * | 9/2011 | Kitajima | H01F 17/045 336/192 |
| 8,072,303 | B2 | 12/2011 | Oki | |
| 8,325,000 | B2 | 12/2012 | Oki et al. | |
| 8,779,878 | B2 * | 7/2014 | Oki | H01F 17/045 335/297 |
| 2007/0188286 | A1 | 8/2007 | Yoshimoto et al. | |
| 2008/0252406 | A1 | 10/2008 | Kitajima et al. | |
| 2010/0141368 | A1 | 6/2010 | Iwakura et al. | |
| 2013/0049915 | A1 | 2/2013 | Oki et al. | |
| 2013/0113585 | A1 | 5/2013 | Oki | |

FOREIGN PATENT DOCUMENTS

| | | | |
|---|---|---|---|
| CN | 103093938 | A | 5/2013 |
| JP | 2000306749 | A | 11/2000 |
| JP | 2004103815 | A | 4/2004 |
| JP | 2005217280 | A | 8/2005 |
| JP | 2007220788 | A | 8/2007 |
| JP | 2009290093 | A | 12/2009 |

* cited by examiner

METHOD OF MAGNETIC CORE

CROSS REFERENCES TO RELATED APPLICATIONS

The present application is a divisional application of U.S. patent application Ser. No. 14/025,371, filed on Sep. 12, 2013, now issued as U.S. Pat. No. 9,064,629 , the entire contents of which are incorporated herein by reference. The 14/025,371 application claimed the benefit of the date of the earlier filed Japanese Patent Application No. JP 2012-200091, filed Sep. 12, 2012, priority to which is also claimed herein, and the contents of which are also incorporated by reference herein.

BACKGROUND OF THE INVENTION

Field of the Invention

The present invention relates to a magnetic core having a winding core portion and a flange portion, a magnetic component using such a magnetic core, and a design method of a magnetic core.

Description of the Related Art

In the past, there have been known a magnetic core provided with flange portions at both end portions of a winding core portion around which a conductive wire is wound, and a magnetic component using such a magnetic core. For example, in Patent Document 1 (Japanese unexamined patent publication No. 2007-173573), there is disclosed a magnetic component (inductor) using a magnetic core provided with disk-like flange portions at both end portions of a cylindrical winding core portion.

With regard to this kind of magnetic component, there are many cases in which the magnetic component is mounted on a circuit board of electronic equipment such as a mobile-phone, portable music media equipment, a portable game machine, a small-sized video camera or the like in which miniaturization request thereof is high. At that time, a region given for mounting the magnetic component (hereinafter, referred to arbitrarily as "mounting region") on the circuit board is restricted, so that miniaturization of the magnetic component is required such that it is possible to accommodate the component within the given mounting region.

The magnetic component described in the Patent Document 1 achieves miniaturization by employing a constitution in which a portion of a terminal placed on the flange portion bottom surface, which extends outward from the flange portion contour line, is to be accommodated within a space (hereinafter, referred to arbitrarily as "excess space") which occurs between a contour line of a flange portion when orthographically-projecting this magnetic component toward the axis line direction of the winding core portion and a square shape circumscribed with this contour line (hereinafter, referred to arbitrarily as "circumscribed square shape").

SUMMARY OF THE INVENTION

As the mounting region on the circuit board is more narrowed and decreased, it becomes difficult to secure a useful excess space in which it is possible, within the mounting region, to arrange the extended portion of the terminal such as described above or the like while securing a necessary space for placing the flange portion (hereinafter, referred to arbitrarily as "space for placing the flange portion").

In order to secure a necessary space for placing the flange portion and a useful excess space within a narrow mounting region, it becomes necessary to utilize the space inside the mounting region efficiently. Specifically, it becomes important to employ a configuration in which a wasted space will not occur within the mounting region while heightening the area ratio of the space for placing the flange portion, which is occupied within the mounting region (hereinafter, referred to arbitrarily as "flange portion occupation-area ratio").

With regard to the magnetic component described in the abovementioned Patent Document 1, in case of setting the inside of the aforementioned circumscribed square shape to be the mounting region, it becomes a situation in which excess spaces having mutually equal sizes & shapes will be formed respectively at the four corners of the mounting region thereof. However, when the mounting region is narrowed and decreased, the areas of the respective excess spaces become small in response thereto and therefore, there is a fear that it becomes impossible to effectively utilize these excess spaces as the spaces for arranging extended portions of the terminals or the like. Also, since the flange portion is formed to be disk-like, it is also difficult to heighten the flange portion occupation-area ratio with respect to the mounting region.

The present invention was invented in view of such a situation and is addressed to provide a magnetic core, a magnetic component and a design method of such a magnetic core in which it is possible to secure a necessary space for placing the flange portion and a useful excess space even within a narrow mounting region.

The magnetic core, the magnetic component and the design method of magnetic core relating to the present invention are provided with the following features.

The magnetic core relating to the present invention is a magnetic core including a winding core portion; and a flange portion provided on the axial end side of at least one of the winding core portion, wherein The flange portion is formed such that contour line OL1 of cross-section P, of the flange portion, which becomes perpendicular with respect to the axis line of the winding core portion forms a shape of a first irregular convex polygon which is substantially a non-regular polygon and also a convex polygon, and the contour line OL1 contacts with respect to all of side Sb1, side Sb2, side Sb3 and side Sb4 which are the four sides of a first circumscribed rectangle which becomes minimum within imaginary rectangles circumscribed with the contour line OL1 and also, the contour line OL1 includes side Sa1 and side Sa2 which respectively overlap with portions of respective ones of the side Sb1 and the side Sb2 which are mutually parallel within the four sides.

According to a magnetic core having such a characterized structure, it becomes possible, by adjusting the shape of the contour line OL1 of the cross-section P of the flange portion corresponding to the shape of the abovementioned first circumscribed rectangle, to secure a useful excess space within the mounting region, in which a terminal or the like is arranged while heightening the flange portion occupation-area ratio in case of setting the inside of the first circumscribed rectangle to be the mounting region.

It should be noted that the word "substantially" in the wording "substantially a non-regular polygon and also a convex polygon" means that even such a drawing which does not become a polygon in a strict sense for the reason that a chamfering process by Radius (R)-chamfering or the like is applied to the corner portions of a polygon is to be treated as a polygon in the present invention.

It is possible for the magnetic core relating to the present invention to be constituted such that for one end portion and the other end portion of one diagonal line Db1 of the first circumscribed rectangle, the cross-section P includes corner cutting portion Ca1 and corner cutting portion Ca2 respectively which are formed such that corner portion Cb1 and corner portion Cb2 positioned on the diagonal line Db1 of the first circumscribed rectangle are removed obliquely.

According to the magnetic core having this aspect, it becomes possible to secure the regions in which the corner portion Cb1 and the corner portion Cb2 are removed as excess spaces for terminals or the like to be arranged therein.

In addition, it is possible for the magnetic core relating to the present invention to be constituted such that for one end portion and the other end portion of the other diagonal line Db2 of the first circumscribed rectangle, the cross-section P includes corner cutting portion Ca3 and corner cutting portion Ca4 respectively which are formed such that corner portion Cb3 and corner portion Cb4 positioned on the diagonal line Db2 of the first circumscribed rectangle are removed obliquely, and which have ½ or less sizes of the corner cutting portion Ca1 and the corner cutting portion Ca2.

According to the magnetic core having this aspect, it becomes possible to heighten the flange portion occupation-area ratio with respect to the mounting region efficiently by setting the sizes of the corner cutting portion Ca3 and the corner cutting portion Ca4 to be sizes of ½ or less of the corner cutting portion Ca1 and the corner cutting portion Ca2.

In addition, in the magnetic core relating to the present invention, it is possible for the contour line OL1 to be formed to have a shape which becomes point-symmetric with regard to the gravity center of the first circumscribed rectangle.

According to the magnetic core having this aspect, it is possible for the flange portion to be made as a point-symmetrical shape, so that it becomes possible to carry out the manufacture of the flange portion easily compared with a case in which the flange portion is made to have a non-point-symmetrical shape.

In addition, in the magnetic core relating to the present invention, it is possible for the winding core portion to be formed such that contour line OL2 of cross-section Q of the winding core portion, which becomes perpendicular with respect to the axis line, forms a shape of a second irregular convex polygon which is substantially a non-regular polygon and also a convex polygon.

According to the magnetic core having this aspect, it becomes possible, by adjusting the shape of the contour line OL2 of the cross-section Q of the winding core portion, to adjust the space between the contour line OL1 and the contour line OL2, which is utilized as a region in which a conductive wire is wound, properly if required.

In addition, in the magnetic core relating to the present invention, it is possible for the cross-section Q to include, at a position corresponding to the corner cutting portion Ca1 of the cross-section P, corner cutting portion Cc1 constituted by corner cutting line Lc1 which becomes parallel with respect to corner cutting line La1 constituting the corner cutting portion Ca1; and for the cross-section Q to include, at a position corresponding to the corner cutting portion Ca2 of the cross-section P, corner cutting portion Cc2 constituted by corner cutting line Lc2 which becomes parallel with respect to corner cutting line La2 constituting the corner cutting portion Ca2.

According to the magnetic core of this aspect, it becomes possible to properly secure the region in which the conductive wire is wound even between the corner cutting line La1 constituting the corner cutting portion Ca1 and the corner cutting line Lc1 constituting the corner cutting portion Cc1 and between the corner cutting line La2 constituting the corner cutting portion Ca2 and the corner cutting line Lc2 constituting the corner cutting portion Cc2.

In addition, in the magnetic core relating to the present invention, it is possible for the winding core portion to be applied, for a predetermined convex corner portion within all convex corner portions in the cross-section Q, with chamfering of ½ or less size with respect to the corner cutting portion Cc1 and the corner cutting portion Cc2.

According to the magnetic core of this aspect, it becomes possible to reduce the possibility in which the conductive wire wound around the winding core portion will be broken by being damaged at a predetermined convex corner portion. Also, by making the chamfering sizes be ½ or less of the sizes of the corner cutting portion Cc1 and the corner cutting portion Cc2, it becomes possible also to prevent the area of the cross-section Q of the winding core portion from decreasing considerably caused by the chamfering.

The magnetic component relating to the present invention is a magnetic component including a magnetic core relating to the present inventions mentioned above and includes:

a winding portion formed by a configuration in which a conductive wire covered by insulation coating is wound around the winding core portion; and a first terminal and a second terminal which are respectively connected to the respective end portions of the winding portion and which are formed by plate-like metals.

In the magnetic component relating to the present invention, it is possible for each of the first terminal and the second terminal to be provided with amount portion abutted to the mounting face of the magnetic core with respect to the substrate and provided with a coupling portion formed integrally with the mount portion, and for the coupling portion of the first terminal and the coupling portion of the second terminal to be connected to one end portion and the other end portion of the winding portion respectively and also, are arranged at the corner cutting portion Ca1 and the corner cutting portion Ca2 of the flange portion respectively.

In addition, in the magnetic component relating to the present invention, it is possible for the coupling portion of the first terminal and the coupling portion of the second terminal to be provided with rising portions formed so as to go respectively along the side surface of the corner cutting portion Ca1 and the side surface of the corner cutting portion Ca2 at the flange portion positioned on the mounting face side of the magnetic core, and provided with extended portions extended in parallel with respect to the mounting face from one end sides of the rising portions respectively; and for the extended portion for the first terminal and the extended portion for the second terminal to be formed so as to be accommodated within a space between the corner cutting portion Ca1 and the first circumscribed rectangle and within a space between the corner cutting portion Ca2 and the first circumscribed rectangle respectively.

The manufacturing method of the magnetic core relating to the present invention is a design method of a magnetic core which includes a winding core portion and a flange portion provided on at least one of the axial end sides of the winding core portion, including the steps of:

setting, on the same design-plane, a first circumscribed rectangle circumscribed to contour line OL1 of cross-section P, of the flange portion, which becomes perpendicular with respect to the axis line of the winding core portion and a second circumscribed rectangle circumscribed to contour line OL2 of cross-section Q which becomes perpendicular with respect to the axis line of the winding core portion;

setting, on the design-plane, an initial shape of the cross-section P and an initial shape of the cross-section Q;

setting, on the design-plane, corner cutting line La1 and corner cutting line La2 which respectively and obliquely remove corner portion Cb1 and corner portion Cb2, of the first circumscribed rectangle, which are positioned on one diagonal line Db1 of the first circumscribed rectangle, to be portions of the contour line OL1;

reducing, on the design-plane, the shape of the cross-section Q at the corner portion Cd1 and the corner portion Cd2, of the second circumscribed rectangle, which correspond to the corner portion Cb1 and the corner portion Cb2 of the first circumscribed rectangle such that a predetermined width of the winding frame is to be secured between the corner cutting line La1 & the corner cutting line La2 and the contour line OL2; and increasing, on the design-plane, the shape of the cross-section Q at other corner portion Cd3 and corner portion Cd4 of the second circumscribed rectangle as much as the reduced degree of the shape of the cross-section Q at the corner portion Cd1 and the corner portion Cd2.

According to a magnetic core and a magnetic component relating to the present invention, it becomes possible, by being provided with the aforementioned characterized structure, to secure a necessary space for placing the flange portion and a useful excess space even within a narrow mounting region.

In addition, according to a design method of a magnetic core relating to the present invention, it becomes possible to design a magnetic core in which there can be secured a necessary space for placing the flange portion and a useful excess space even within a narrow mounting region.

DESCRIPTION OF THE PREFERRED EMBODIMENTS

Hereinafter, there will be explained exemplified embodiments of a magnetic core, a magnetic component and a design method of the magnetic core relating to the present invention in detail while referring to the abovementioned drawings.

<Constitution of Magnetic Core>

Figure 1:
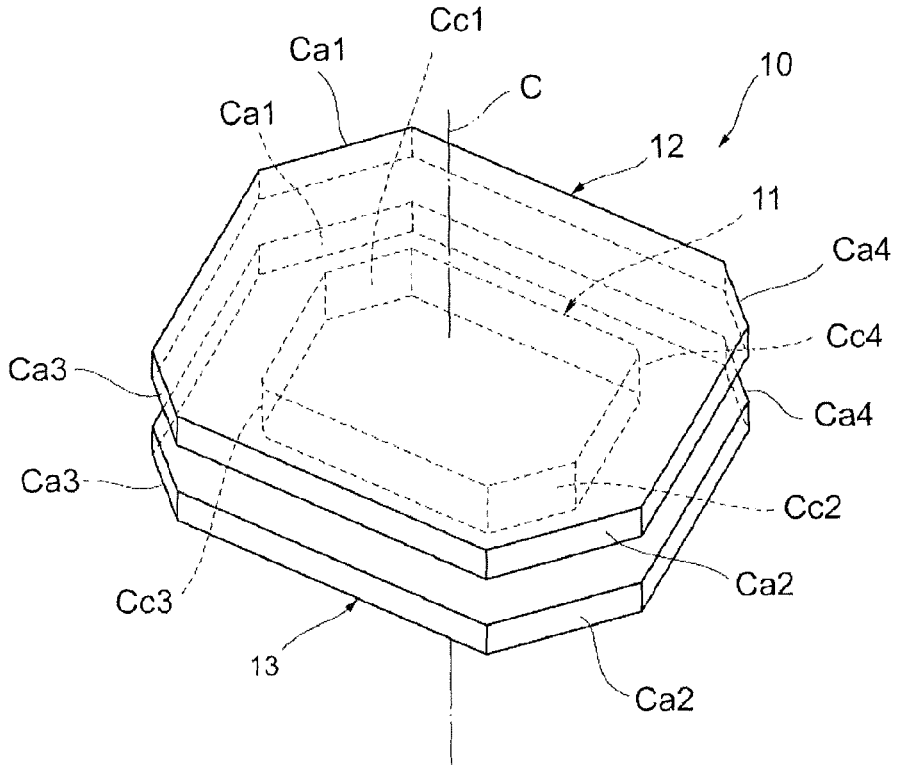
FIG. 1 is a perspective view showing a whole constitution of a magnetic core relating to one exemplified embodiment of the present invention.
Figure 2:
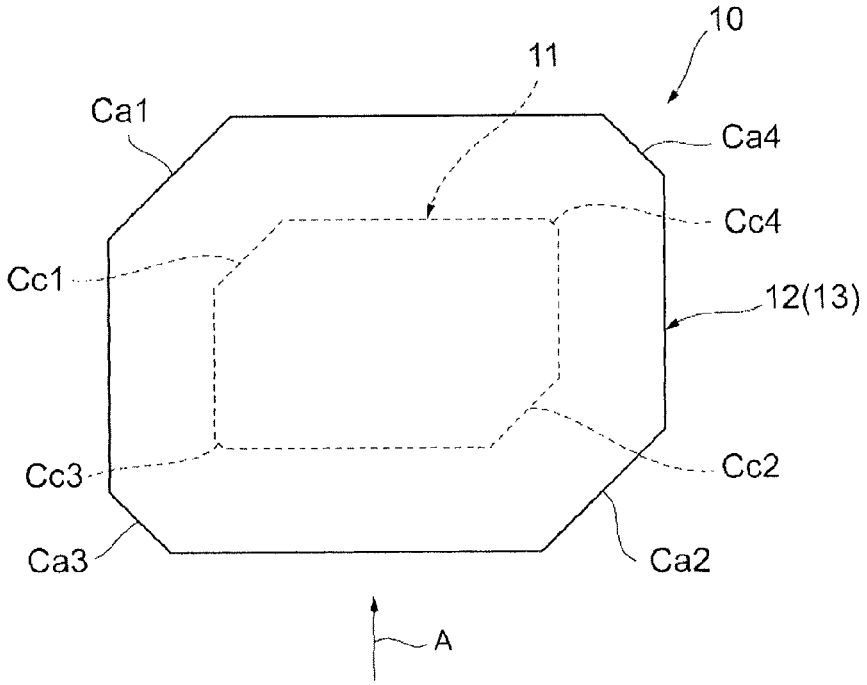
FIG. 2 is a plan view of the magnetic core shown in FIG. 1.
Figure 3:
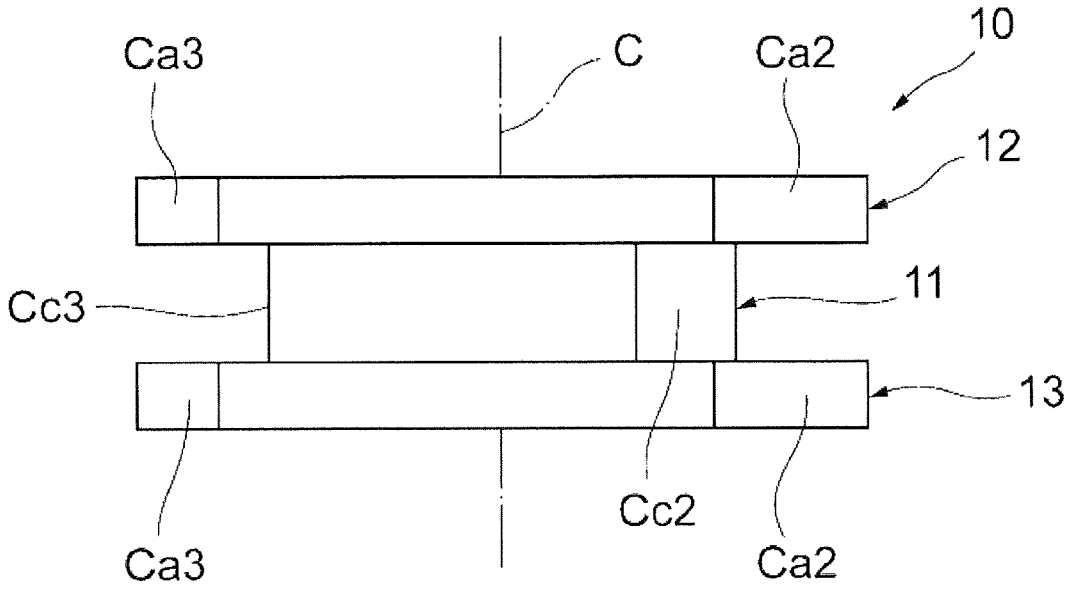
FIG. 3 is a side view of the magnetic core seen from an arrow A direction shown in FIG. 2.

As shown in FIGS. 1 to 3, a magnetic core 10 relating to one exemplified embodiment of the present invention is constituted such that a winding core portion 11, a first flange portion 12 arranged on one axial end side (one end side in axis line C direction) of this winding core portion 11 and a second flange portion 13 arranged on the other axial end side (the other terminal side in axis line C direction) of the winding core portion 11 are formed integrally with one another. The first flange portion 12 and the second flange portion 13 are formed to be in rectangular-cylinder shapes having same sizes and same shapes as each other, and also the winding shaft portion 11 is formed to be in a rectangular-cylinder shape (details of the cross-section shape will be described later).

Also, the magnetic core 10 is formed, for example, by a ferrite of a soft magnetic material (other than "ferrite", it is also possible to use a material such as permalloy, sendust, iron carbonyl and the like or to use a dust core formed by compression-molding the fine powders thereof). It should be noted that in case of forming the magnetic core 10 by an Ni—Zn-based ferrite or by an Mn—Zn-based ferrite, it becomes possible to miniaturize the magnetic core 10 compared with a case in which the magnetic core 10 is formed by an Fe—Si-based alloy or by an Fe—Ni-based alloy.

<Shapes of Flange Portion and Winding Core Portion>

Figure 4:
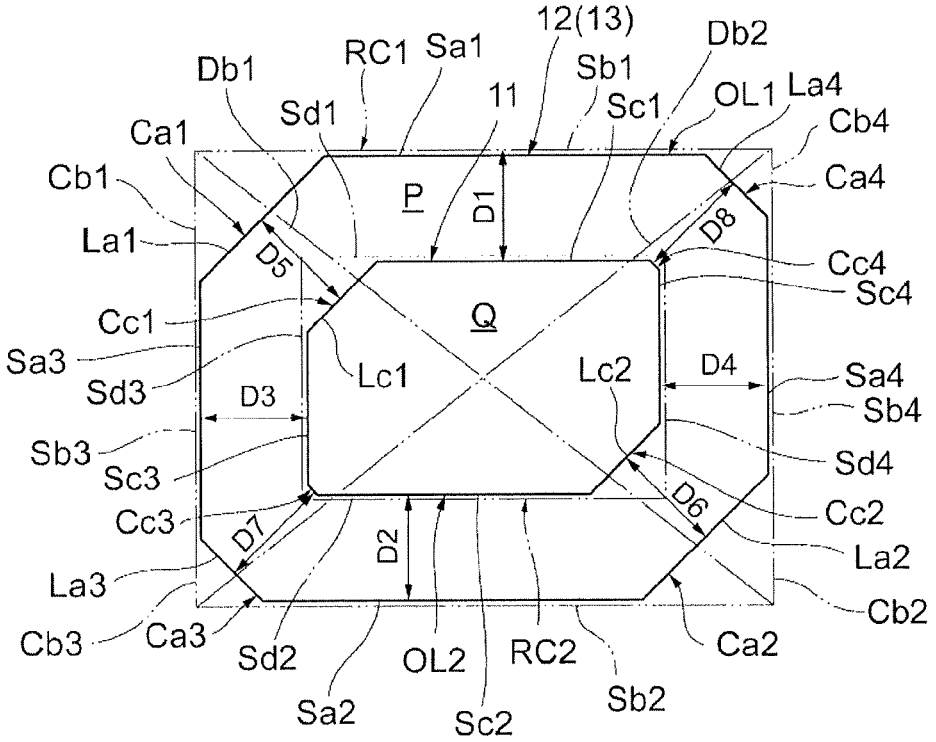
FIG. 4 is a schematic diagram showing features of contour shapes in the respective cross-sections of the flange portion and the winding core portion of the magnetic core shown in FIGS. 1 to 3.

Next, while referring to FIG. 4, there will be explained the features of the shapes of the first flange portion 12 (the second flange portion 13) and the winding shaft portion 11. In FIG. 4, cross-section P of the first flange portion 12 and cross-section Q of the winding core portion 11, which become perpendicular respectively with respect to the axis line C shown in FIGS. 1 and 3, are indicated in a state in which the mutual relative positional relations thereof are maintained. It should be noted that the first flange portion 12 and the second flange portion 13 have the same shapes as each other, and the feature points of the shape relating to the first flange portion 12, which will be explained hereinafter, are similarly included also in the second flange portion 13.

Also, in FIG. 4, a first circumscribed rectangle RC1 and a second circumscribed rectangle RC2 are indicated by two-dot chain lines respectively. The first circumscribed rectangle RC1 is a rectangle which becomes minimum within imaginary rectangles circumscribed with the contour line OL1 of the cross-section P and the second circumscribed rectangle RC2 is a rectangle which becomes minimum within imaginary rectangles circumscribed with the contour line OL2 of the cross-section Q. It should be noted in FIG. 4 that the first circumscribed rectangle RC1 is drawn a little bit larger in order to make it easy to distinguish the first circumscribed rectangle RC1 and the contour line OL1 of the cross-section P. Similarly, also the second circumscribed rectangle RC2 is drawn a little bit larger (drawn similarly also in FIGS. 5 and 8 to 15) in order to make the distinction from the contour line OL2 of the cross-section Q easier.

As shown in FIG. 4, the contour line OL1 of the cross-section P of the first flange portion 12 forms a shape of a first irregular convex polygon (irregular convex octagon in this exemplified embodiment), which is substantially an non-regular polygon and also a convex polygon. Also, this contour line OL1 contacts with respect to all of side Sb1, side Sb2, side Sb3 and side Sb4 which are the four sides of the abovementioned first circumscribed rectangle RC1. Further, the contour line OL1 includes side Sa1 and side Sa2 which respectively overlap with respective ones of portions of the abovementioned side Sb1 and the abovementioned side Sb2 which are in parallel with each other within the abovementioned four sides, and includes side Sa3 and side Sa4 which respectively overlap with respective ones of portions of the abovementioned side Sb3 and the abovementioned side Sb4 which are in parallel with each other.

Also, the abovementioned cross-section P includes corner cutting portion Ca1 and corner cutting portion Ca2 at one end portion and the other end portion of one diagonal line Db1 of the abovementioned first circumscribed rectangle RC1 respectively. The corner cutting portion Ca1 is constituted by corner cutting line La1 which is formed so as to obliquely remove one corner portion Cb1 positioned on the diagonal line Db1 of the first circumscribed rectangle RC1. Similarly, the corner cutting portion Ca2 is constituted by corner cutting line La2 which is formed so as to obliquely remove the other corner portion Cb2 positioned on the diagonal line Db1 of the first circumscribed rectangle RC1. It should be noted in this exemplified embodiment that both of the inclination angle of the corner cutting line La1 with respect to the sides Sa1, Sa3 of the abovementioned contour line OL1 and the inclination angle of the corner cutting line La2 with respect to the abovementioned sides Sa2, Sa4 are constituted so as to become 45 degrees (it is possible to employ other inclination angles).

Further, the abovementioned cross-section P includes corner cutting portion Ca3 and corner cutting portion Ca4 at one end portion and the other end portion of the other diagonal line Db2 of the abovementioned first circumscribed rectangle RC1 respectively. The corner cutting portion Ca3 is constituted by corner cutting line La3 which is formed so as to obliquely remove one corner portion Cb3 positioned on the diagonal line Db2 of the first circumscribed rectangle RC1. Similarly, the corner cutting portion Ca4 is constituted by corner cutting line La4 which is formed so as to obliquely remove the other corner portion Cb4 positioned on the diagonal line Db2 of the first circumscribed rectangle RC1. It should be noted in this exemplified embodiment that both of the inclination angle of the corner cutting line La3 with respect to the sides Sa2, Sa3 of the abovementioned contour line OL1 and the inclination angle of the corner cutting line La4 with respect to the abovementioned sides Sa1, Sa4 are constituted so as to become 45 degrees (it is possible to employ other inclination angles).

It should be noted that the size of the corner cutting portion Ca1 (area of the removed region of the corner portion Cb1) and the size of the corner cutting portion Ca2 (area of the removed region of the corner portion Cb2) are constituted to become equal to each other. Also, the corner cutting line La1 constituting the corner cutting portion Ca1 and the corner cutting line La2 constituting the corner cutting portion Ca2 are constituted to be in parallel with each other and also to have the same isometries.

Similarly, the size of the corner cutting portion Ca3 (area of the removed region of corner portion Cb3) and the size of the corner cutting portion Ca4 (area of the removed region of corner portion Cb4) are constituted so as to become equal to each other, and the corner cutting line La3 constituting the corner cutting portion Ca3 and the corner cutting line La4 constituting the corner cutting portion Ca4 are constituted to be in parallel with each other and also to have the same isometries.

Also, the corner cutting portion Ca3 and the corner cutting portion Ca4 are constituted so as to have sizes of 1/10 or more and 1/2 or less (preferably, 1/5 or more and 1/2 or less) with respect to the sizes of the corner cutting portion Ca1 and the corner cutting portion Ca2.

Further, the contour line OL1 of the abovementioned cross-section P is formed to have a shape which becomes point-symmetric with regard to the gravity center of the first circumscribed rectangle RC1 (intersection point between the two lines of diagonal lines Db1, Db2). By employing the point-symmetrical shape, the process when forming the first flange portion 12 (second flange portion 13) becomes easy.

On the other hand, the contour line OL2 of the cross-section Q of the winding core portion 11 forms a shape of a second irregular convex polygon (this becomes irregular convex hexagon in case of counting each of the after-mentioned convex corner portions Cc3, Cc4 as one corner) which is an non-regular polygon and also a convex polygon substantially. Also, this contour line OL2 contacts with respect to all of side Sd1, side Sd2, side Sd3 and side Sd4 which are four sides of the abovementioned second circumscribed rectangle RC2. Further, the contour line OL2 includes side Sc1 and side Sc2 which respectively overlap with portions of respective ones of the abovementioned side Sd1 and the abovementioned side Sd2 which are mutually parallel and side Sc3 and side Sc4 which respectively overlap with portions of respective ones of the abovementioned side Sd3 and the abovementioned side Sd4 within the abovementioned four sides.

Also, the abovementioned cross-section Q includes, at the position corresponding to the corner cutting portion Ca1 of the abovementioned cross-section P, corner cutting portion Cc1 constituted by the corner cutting line Lc1 which becomes parallel with respect to the abovementioned corner cutting line La1 constituting this corner cutting portion Ca1. Similarly, the cross-section Q includes, at the position corresponding to the corner cutting portion Ca2 of the abovementioned cross-section P, corner cutting portion Cc2 constituted by the corner cutting line Lc2 which becomes parallel with respect to the abovementioned corner cutting line La2 constituting this corner cutting portion Ca2.

Also, for the winding core portion 11, Chamfer (C)-chamfering is applied (Radius (R)-chamfering is also possible) at the convex corner portion Cc3 formed at the position corresponding to the corner cutting portion Ca3 of the abovementioned cross-section P and at the convex corner portion Cc4 formed at the position corresponding to the corner cutting portion Ca4 of the abovementioned cross-section P within all the convex corner portions in the abovementioned cross-section Q. This chamfering size (size of the region which is cut-out by the chamfering in the cross-section Q) is made to be ½ or less (preferably, ⅕ or less) of the size of the aforementioned corner cutting portion Cc1 and the corner cutting portion Cc2.

By applying such a chamfering, it becomes possible to prevent the conductive wire from being damaged and disconnected at the convex corner portions Cc3, Cc4 when winding the conductive wire around the winding core portion 11.

Also, in the magnetic core 10, a space region which is formed among the circumference surface of the winding core portion 11, the lower surface of the first flange portion 12 (surface on the side faced to the second flange portion 13) and the upper surface of the second flange portion 13 (surface on the side faced to the first flange portion 12) is formed as a region in which a conductive wire can be wound around the winding core portion 11 (see FIG. 1). In this exemplified embodiment, the width of this region in which the winding can be applied (length in a direction perpendicular to axis line C and hereinafter, this is referred to arbitrarily as "width of the winding frame") is constituted to be approximately isometric over the whole circumference of the winding core portion 11. Specifically, as shown in FIG. 4, when assuming that the width of the winding frame between the side Sa1 and the side Sc1 is D1, the width of the winding frame between the side Sa2 and the side Sc2 is D2, the width of the winding frame between the side Sa3 and the side Sc3 is D3, the width of the winding frame between the side Sa4 and the side Sc4 is D4, the width of the winding frame between the corner cutting line La1 and the corner cutting line Lc1 is D5, the width of the winding frame between the corner cutting line La2 and the convex corner portion Cc2 is D6, the width of the winding frame between the corner cutting line La3 and the convex corner portion Cc3 is D7, and the width of the winding frame between the corner cutting line La4 and the convex corner portion Cc4 is D8 respectively, there is employed a configuration in which D1=D2=D3=D4=D5=D6=D7=D8 is satisfied.

It should be noted that the aforementioned corner cutting portions Ca1, Ca2, Ca3, Ca4, Cc1, Cc2 and convex corner portions Cc3, Cc4 are the portions defined for the contour line OL1 of the cross-section P and for the contour line OL2 of the cross-section Q, both of which are shown in FIG. 4, but in order to easily comprehend the shape of the magnetic core 10, reference numerals attached to those positions in FIG. 4 are described also at the positions corresponding to those positions in other drawings (FIGS. 1 to 3, FIG. 4, FIG. 5).

<Constitution of Magnetic Component>

Figure 5:
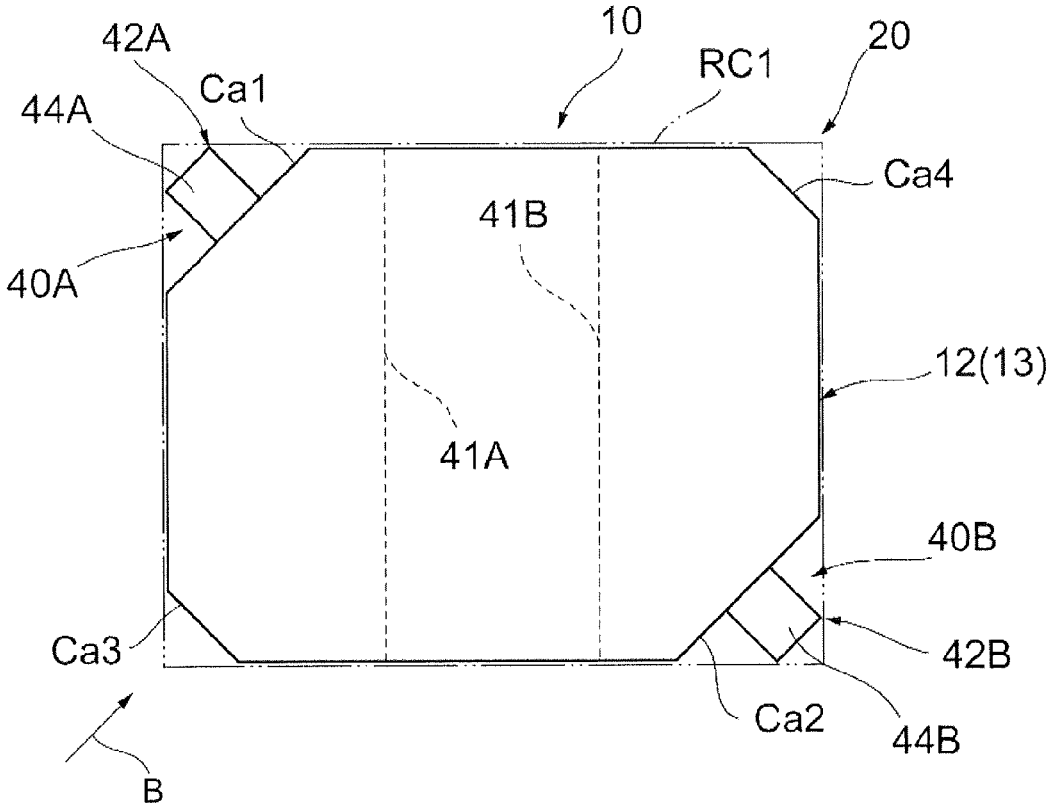
FIG. 5 is a plan view of a magnetic component relating to one exemplified embodiment of the present invention.
Figure 6:
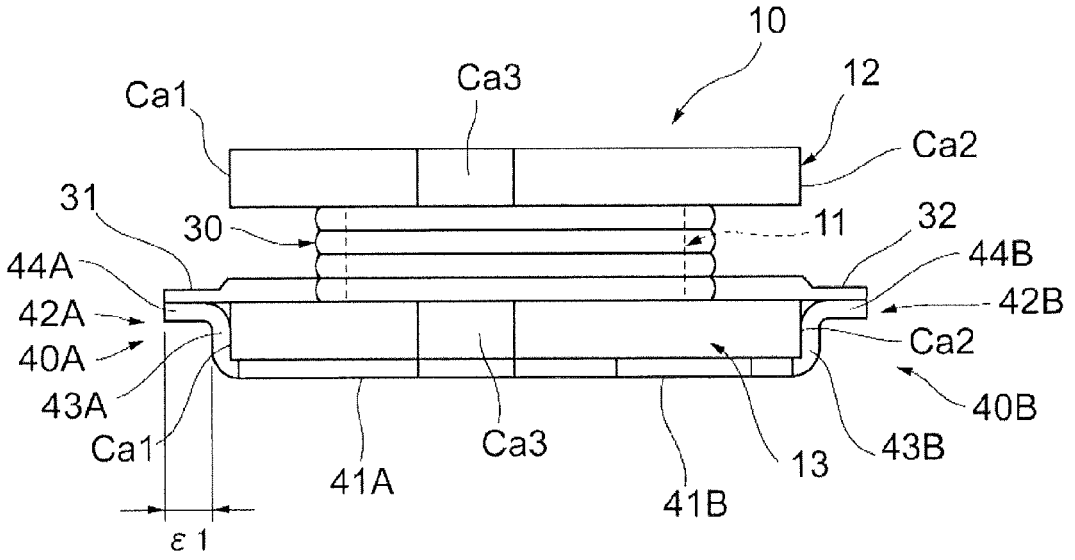
FIG. 6 is a side view of the magnetic component seen from an arrow B direction shown in FIG. 5.

A magnetic component 20 relating to one exemplified embodiment of the present invention is provided, as shown in FIGS. 5, 6, with the magnetic core 10 mentioned above, a winding portion (coil) 30 composed of a conductive wire covered by an insulation coating, which is wound around the abovementioned winding core portion 11 (indicated by broken lines in FIG. 6) of this magnetic core 10, and a first terminal 40A and a second terminal 40B which are formed by plate-like metals. It should be noted in FIG. 5 that portions of respective contour lines of the first terminal 40A and the second terminal 40B are indicated by broken lines.

The first terminal 40A is provided with a mount portion 41A which is abutted on amounting face (bottom surface of the second flange portion 13 shown in FIG. 6 (downside surface in the drawing)) of the magnetic core 10 with respect to a circuit board (not-shown) and provided with a coupling portion 42A which is formed integrally with this mount portion 41A. Similarly, the second terminal 40B is provided with a mount portion 41B which is abutted on the abovementioned mounting face of the magnetic core 10 and provided with a coupling portion 42B which is formed integrally with this mount portion 41B.

The coupling portion 42A of the abovementioned first terminal 40A is provided with a rising portion 43A which is formed so as to be along the side surface of the corner cutting portion Ca1 of the flange portion 13 and an extended portion 44A which is extended in parallel with respect to the abovementioned mounting face from one end side of this rising portion 43A. Also, this extended portion 44A is connected with one end portion 31 of the abovementioned winding portion 30 by welding or the like (it is allowed to employ a configuration of connection by soldering or thermo-compression bonding, or a configuration of connection by soldering after twisting one end portion 31 of the winding portion 30 around the extended portion 44A).

Similarly, the coupling portion 42B of the abovementioned second terminal 40B is provided with a rising portion 43B which is formed so as to be along the side surface of the corner cutting portion Ca2 of the flange portion 13 and an extended portion 44B which is extended in parallel with respect to the abovementioned mounting face from one end side of this rising portion 43B. Also, this extended portion 44B is connected with the other end portion 32 of the abovementioned winding portion 30 by welding or the like (it is allowed to employ a configuration of connection by soldering or thermo-compression bonding, or a configuration of connection by soldering after twisting the other end portion 32 of the winding portion 30 around the extended portion 44B).

Also, as shown in FIG. 5, the abovementioned extended portion 44A for the first terminal 40A is formed so as to be accommodated within the space between the corner cutting portion Ca1 of the flange portion 13 and the aforementioned first circumscribed rectangle RC1. Similarly, the abovementioned extended portion 44B for the second terminal 40B is formed so as to be accommodated within the space between the corner cutting portion Ca2 of the flange portion 13 and the aforementioned first circumscribed rectangle RC1. Thus, as shown FIG. 6, it becomes possible for the length $\epsilon$1 of the extended portion 44A in the first terminal 40A to be secured sufficiently (this is similar also for the extended portion 44B in the second terminal 40B).

<Design Method of Magnetic Core>

Next, while referring to FIGS. 7 to 12, there will be explained a design method of a magnetic core relating to one exemplified embodiment of the present invention (hereinafter, referred to arbitrarily as "design method of this exemplified embodiment") by taking a case in which the magnetic core 10 mentioned above is to be designed as an example.

Figure 7:
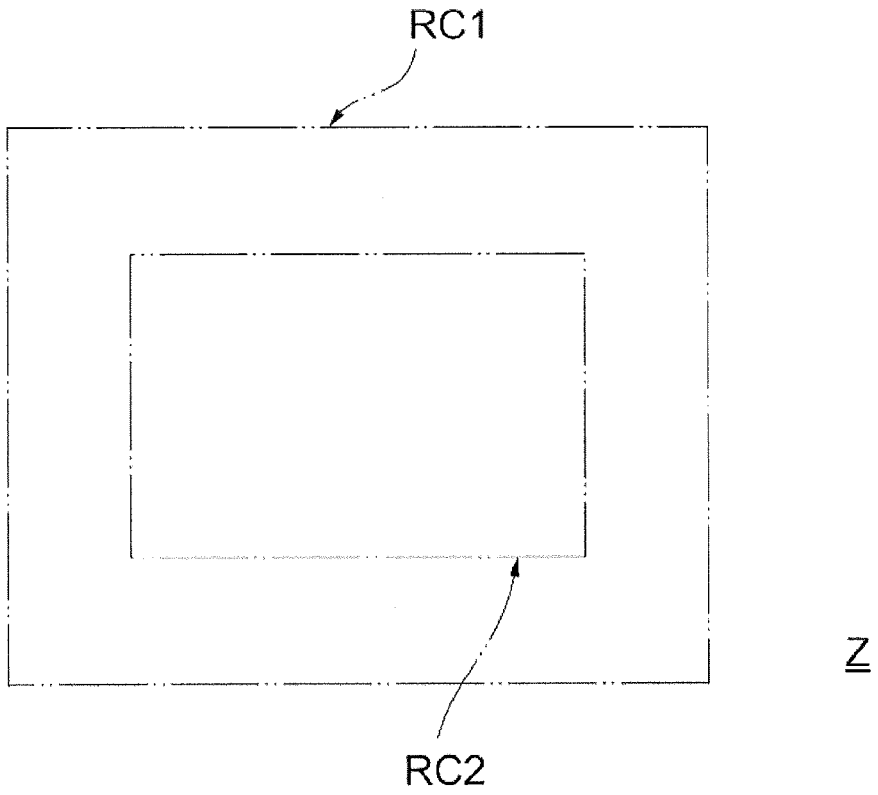
FIG. 7 is a schematic diagram showing a circumscribed-rectangle setting step in a design method of a magnetic core relating to one exemplified embodiment of the present invention.

(1) As shown in FIG. 7, the first circumscribed rectangle RC1 and the second circumscribed rectangle RC2 are set on a design-plane Z (circumscribed-rectangle setting step). The first circumscribed rectangle RC1 is a rectangle circumscribed to the contour line OL1 (see FIGS. 8 to 12) of the cross-section P of the first flange portion 12, which is designed after the next step and, for example, the size and the shape thereof are set based on the shape, the area and the like of the mounting region which is given on the circuit board. The first circumscribed rectangle RC2 is a rectangle circumscribed to the contour line OL2 (see FIGS. 8 to 12) of the cross-section Q of the winding core portion 11, which is designed after the next step and, for example, the size and the shape thereof are set based on the area required in the cross-section Q, the necessary width of the winding frame and the like.

Figure 8:
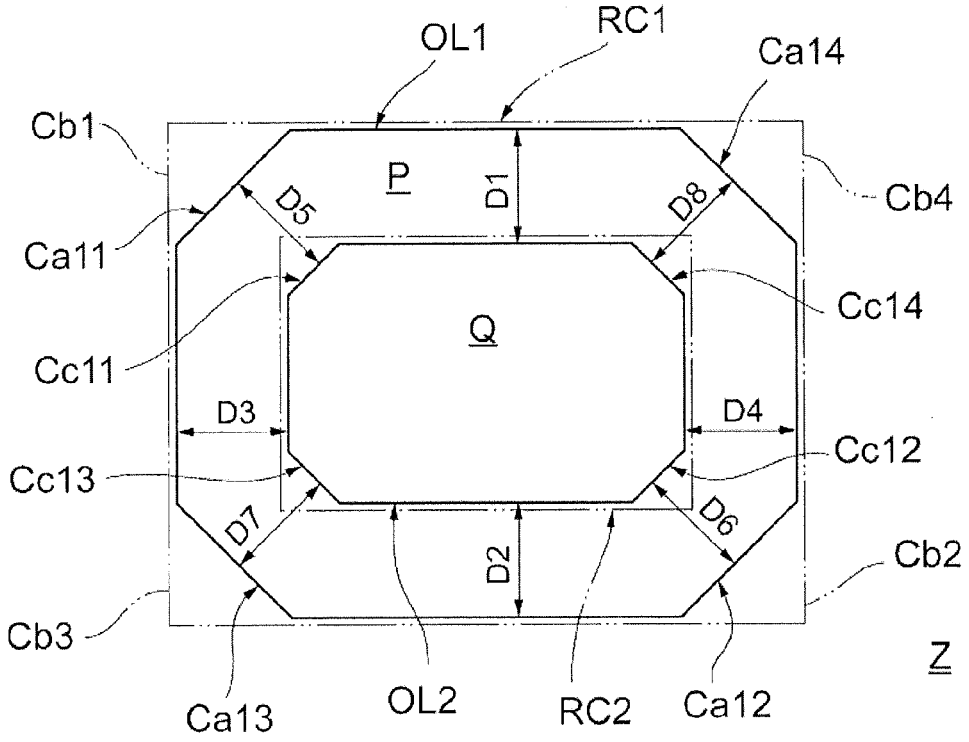
FIG. 8 is a schematic diagram showing a cross-section initial-shape setting step in the abovementioned design method.

(2) As shown in FIG. 8, an initial shape of the cross-section P and an initial shape of the cross-section Q are set on the design-plane Z (initial-shape setting step of cross-section). In the design method of this exemplified embodiment, the initial shape of the cross-section P is set such that the contour line OL1 thereof is designed to have a shape of a convex octagon provided with four corner cutting portions Ca11, Ca12, Ca13 and Ca14 which have mutually the same sizes at the positions corresponding to the respective ones of the four corner portions Cb1, Cb2, Cb3 and Cb4 of the first circumscribed rectangle RC1.

Also, in the design method of this exemplified embodiment, the initial shape of the cross-section Q is set such that the contour line OL2 thereof is designed to have a shape of a convex octagon provided with four corner cutting portions Cc11, Cc12, Cc13 and Cc14 which have mutually the same sizes at the positions corresponding to the respective ones of the four corner cutting portions Ca11, Ca12, Ca13 and Ca14 of the abovementioned contour line OL1. It should be noted that the sizes of the corner cutting portions Cc11, Cc12, Cc13 and Cc14 are set, for example, such that a predetermined width of the winding frame is to be secured between the contour line OL1 and the contour line OL2 over the whole circumference of the contour line OL2 (widths of the winding frames D1 to D8 shown in FIG. 8 are isometric with one another). It should be noted that the width of the winding frame is determined by wire diameter and material property of the conductive wire to be wound, the required number of windings or the like.

Figure 9:
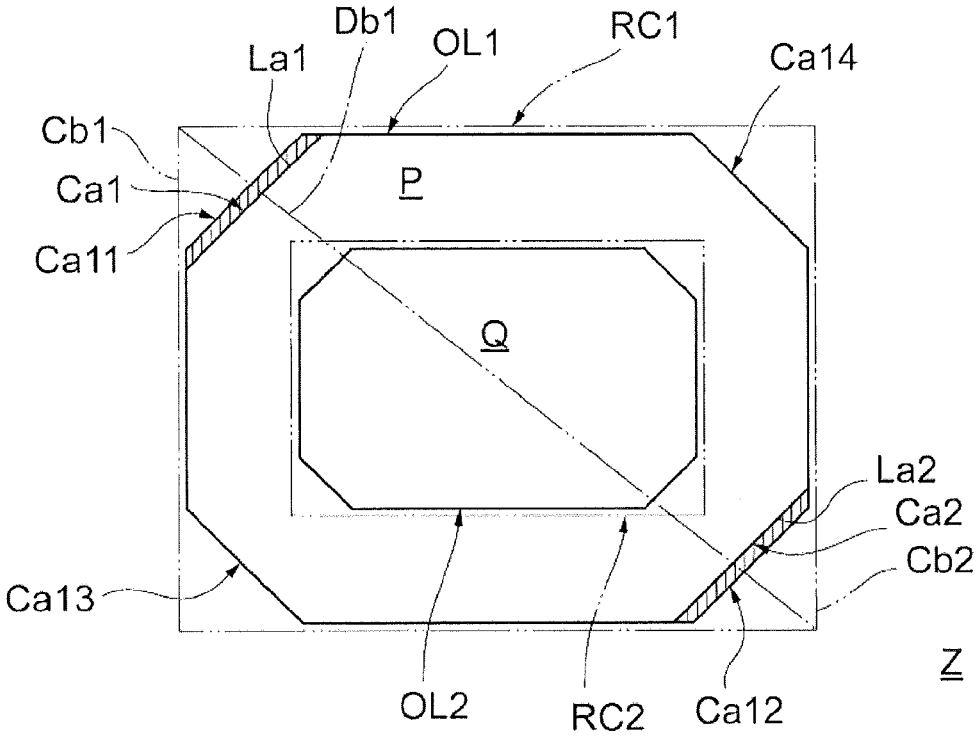
FIG. 9 is a schematic diagram showing a flange-portion corner cutting line setting step in the abovementioned design method.

(3) As shown in FIG. 9, there will be set, on the design-plane Z, corner cutting lines La1 and La2 which remove the corner portions Cb1 and Cb2 of the first circumscribed rectangle RC1, which are positioned on the one diagonal line Db1 of the first circumscribed rectangle RC1, respectively obliquely as portions of the contour line OL1 (cutting line setting step of flange-portion corner). In this exemplified embodiment, portions of the corner cutting portions Ca11 and Ca12 of the contour line OL1 are cut-out (portions to be cut-out are indicated by shaded portions), and the corner cutting lines La1 and La2 are to be set. It should be noted that when portions of the corner cutting portions Ca11 and Ca12 are cut-out, it becomes a situation in which the sizes (areas of removed regions of the corner portions Cb1 and Cb2) of the corner cutting portions Ca11 and Ca12 themselves are expanded. Hereinafter, the corner cutting portion Ca11 expanded by the cut-out is to be referred to as corner cutting portion Ca1 and similarly, the corner cutting portion Ca12 expanded by the cut-out is to be referred to as corner cutting portion Ca2. By designing the corner cutting portions Ca1, Ca2 in this manner, it becomes possible to expand the areas of terminal extended portions (extended portion 44A of first terminal 40A and extended portion 44B of second terminal 40B) which are arranged on the corner cutting portions Ca1, Ca2, so that it becomes possible to connect the terminal extended portions and the winding wire end portions stably.

Figure 10:
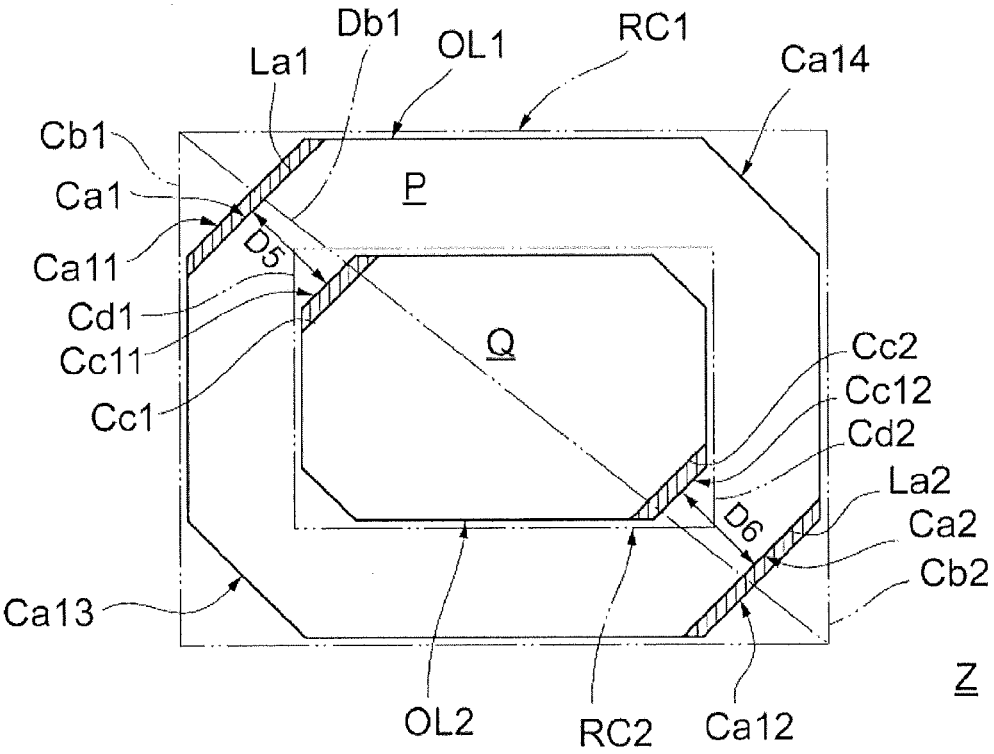
FIG. 10 is a schematic diagram showing a winding core-portion reducing step in the abovementioned design method.

(4) As shown in FIG. 10, the shape of the cross-section Q in the corner portions Cd1 and Cd2 of the second circumscribed rectangle RC2, which correspond to the corner portions Cb1 and Cb2 of the first circumscribed rectangle RC1, is reduced such that predetermined widths of the winding frames D5 and D6 are to be secured between the abovementioned corner cutting lines La1 and La2 and the abovementioned contour line OL2 on the design-plane Z (winding core-portion reducing step). In this exemplified embodiment, it becomes a situation in which portions of the corner cutting portions Cc11 and Cc12 of the contour line OL2 are to be cut-out (portions to be cut-out is indicated by shaded portions). It should be noted that similarly as the aforementioned corner cutting portions Ca11 and Ca12, when portions of the corner cutting portions Cc11 and Cc12 are cut-out, it becomes a situation in which the sizes of the corner cutting portions Cc11 and Cc12 themselves are expanded. Hereinafter, the corner cutting portion Cc11 expanded by the cut-out is to be referred to as corner cutting portion Cc1 and similarly, the corner cutting portion Cc12 expanded by the cut-out is to be referred to as corner cutting portion Cc2.

Figure 11:
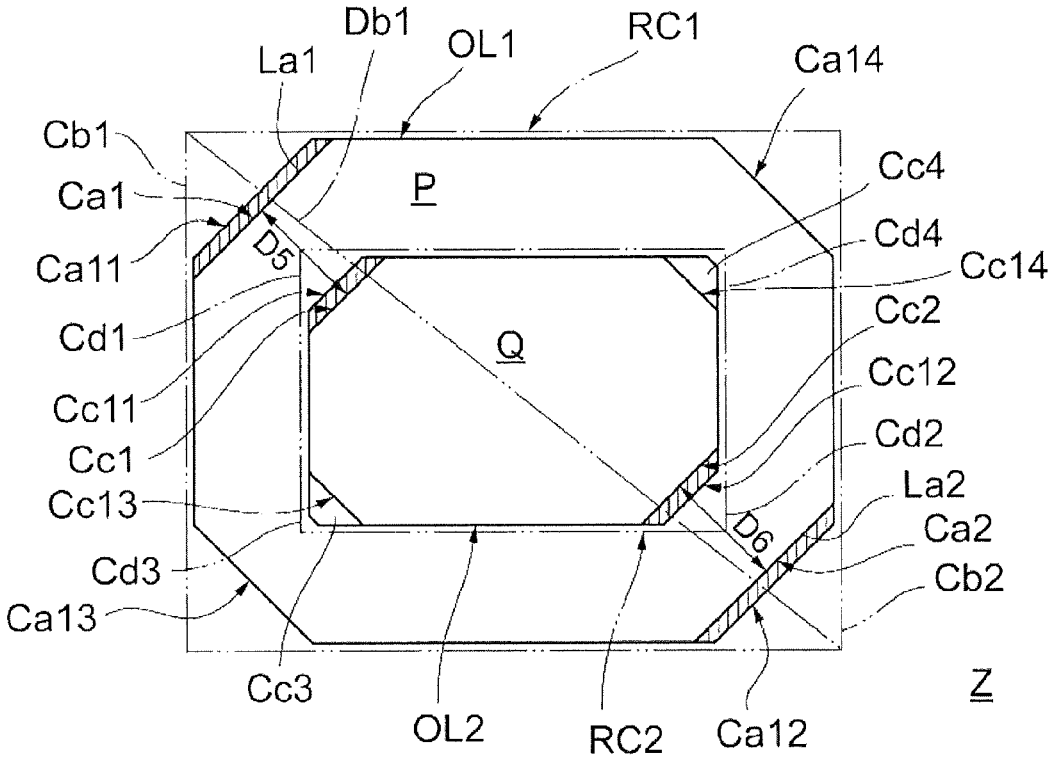
FIG. 11 is a schematic diagram showing a winding core-portion increasing step in the abovementioned design method.

(5) As shown in FIG. 11, the shapes of the cross-section Q at the other corner portions Cd3 and Cd4 of the second circumscribed rectangle RC2 are increased on the design-plane Z by a degree as much as the reduction of the shapes of the cross-section Q at the aforementioned corner portion Cd1 and corner portion Cd2 (winding core-portion increasing step). In this exemplified embodiment, caused by the increase of this cross-section Q, it becomes a situation in which the convex corner portion Cc3 is formed by reducing the corner cutting portion Cc13 of the contour line OL2 and similarly, the convex corner portion Cc4 is formed by reducing the corner cutting portion Cc14 of the contour line OL2. It should be noted that the corner portion areas Cc3 and Ca4 are set so as to be applied with Chamfer (C)-chamfering (Radius (R)-chamfering is also possible. Depending on such a design, it is possible for the cross-section area Q of the winding core portion, which became small in the aforementioned winding core-portion reducing step, to be enlarged to a size equivalent to or more than the size at the time of the initial shape, so that it becomes possible to prevent a phenomenon in which the magnetic property of the magnetic core is lowered by the fact that the cross-section area Q of the winding core portion becomes small.

Figure 12:
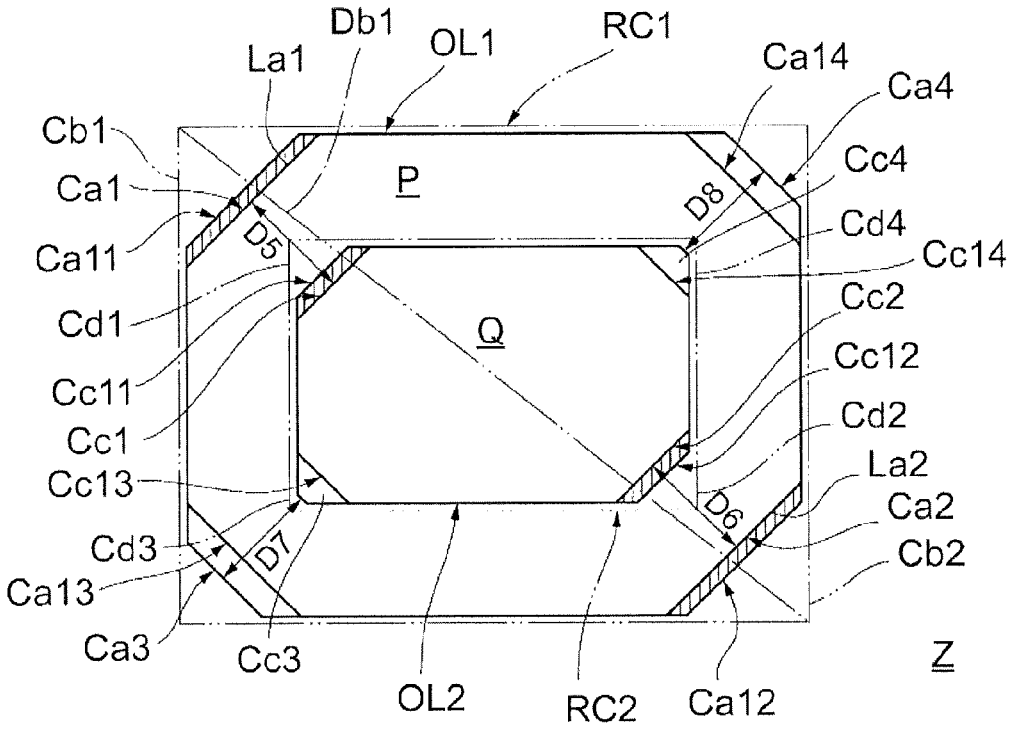
FIG. 12 is a schematic diagram showing a flange-portion increasing step in the abovementioned design method.

(6) As shown in FIG. 12, the shape of the cross-section P at the corner portions Cb3 and Cb4 of the first circumscribed rectangle RC1 is increased such that predetermined widths of the winding frames D7 and D8 are to be secured between the aforementioned convex corner portions Cc3 and Cc4 and the abovementioned contour line OL1 on the design-plane Z (flange-portion increasing step). In this exemplified embodiment, caused by the increase of this cross-section P, it becomes a situation in which the corner cutting portions Ca13 and Ca14 of the contour line OL1 are to be reduced. Hereinafter, the reduced corner cutting portion Ca13 will be referred to as corner cutting portion Ca3 and similarly, the reduced corner cutting portion Ca14 will be referred to as corner cutting portion Ca4.

According to the procedures described above, the design of the respective cross-sections P, Q of the first flange portion 12 and the winding core portion 11 in the magnetic core 10 mentioned above is completed. It should be noted that it is unnecessary for the increase of the cross-section P in the aforementioned flange-portion increasing step to be carried out in a case in which predetermined widths of the winding frames D7 and D8 are secured beforehand between the convex corner portion Cc3 and the corner cutting portion Ca13 and between the convex corner portion Cc4 and the corner cutting portion Ca14. It is possible for the magnetic core 10 designed in this manner to possess a magnetic property equivalent to or more than the magnetic property in comparison with the magnetic core having the initial shape shown in FIG. 8 and furthermore, it is possible to enlarge the area of the terminal extended portion to be placed thereon, so that it can be expected also to contribute to miniaturization of the magnetic component and improvement of yield rate thereof.

<Modified Aspect>

As described above, there were explained exemplified embodiments of the present invention, but the present invention is not to be limited by the aforementioned exemplified embodiments and it is possible to change the aspect variously.

Figure 13:
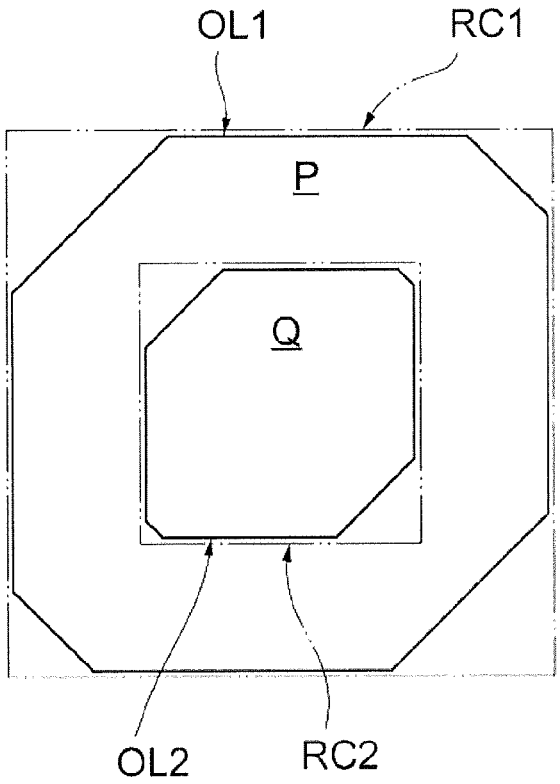
FIG. 13 is a view showing a modified aspect in a case in which the shape of the circumscribed rectangle becomes a square shape.

For example, in the aforementioned exemplified embodiments, the first circumscribed rectangle RC1 and the second circumscribed rectangle RC2 are respectively designed to be rectangles each of which has a non-square shape, but it is also possible for one or both thereof to be made in square shape. FIG. 13 shows one example of respective shapes of the contour line OL1 of the cross-section P and the contour line OL2 of the cross-section Q in a case in which the first circumscribed rectangle RC1 and the second circumscribed rectangle RC2 are designed to have square shapes respectively.

Figure 14:
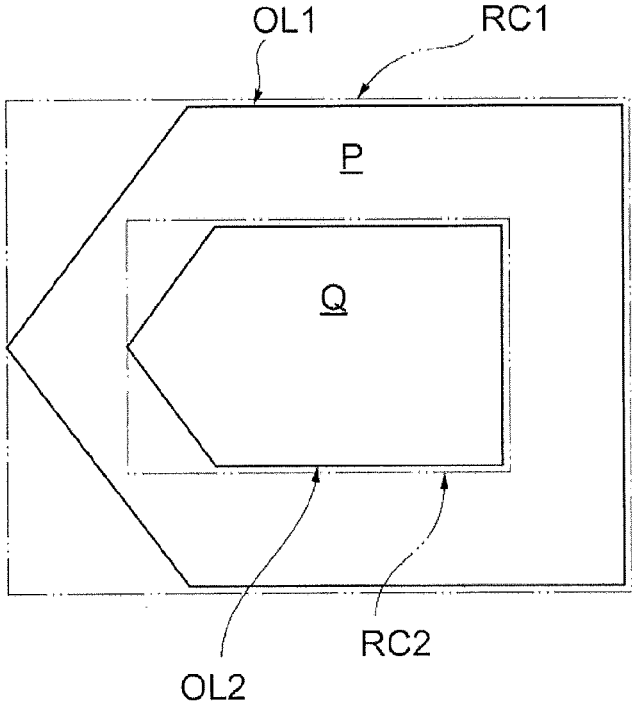
FIG. 14 is a view of a modified aspect in which respective contour-line shapes of the flange portion and the winding core portion become convex pentagon-shapes.
Figure 15:
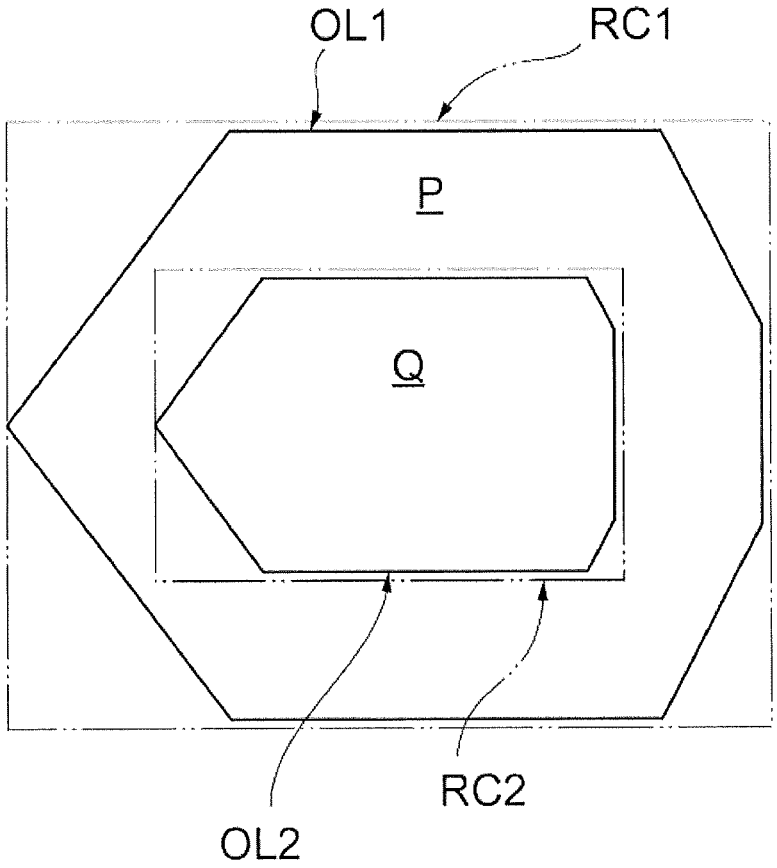
FIG. 15 is a view showing a modified aspect in which respective contour-line shapes of the flange portion and the winding core portion become convex heptagons.

Also, in the aforementioned exemplified embodiment, the contour line OL1 of the cross-section P and the contour line OL2 of the cross-section Q are formed so as to become irregular convex octagon-shapes respectively, but it is also possible for those lines to be formed in shapes of other irregular convex polygons. FIG. 14 shows one example in a case in which the contour line OL1 of the cross-section P and the contour line OL2 of the cross-section Q are designed to be shapes of irregular convex pentagons respectively, and FIG. 15 shows one example of a case in which the contour line OL1 of the cross-section P and the contour line OL2 of the cross-section Q are designed to be irregular convex heptagon-shapes respectively.

Also, in the aforementioned exemplified embodiments, the width of the winding frame between the contour line OL1 of the cross-section P and the contour line OL2 of the cross-section Q is constituted to be isometric over the whole circumference of the winding core portion 11 (see FIG. 4), but it is also possible for the width of the winding frame to be changed according to the position thereof. For example, there can be cited a case, as one example, in which the widths of the winding frames D1 to D8 shown in FIG. 4 are set so as to become D5=D6=D7=D8<D1=D2<D3=D4 or the like.

Also, in the exemplified embodiments of the design method of the aforementioned magnetic core, the initial shape of the contour line OL1 of the cross-section P and the initial shape of the contour line OL2 of the cross-section Q are set to be convex octagons respectively, but it is allowed to employ initial shapes having other arbitrary shapes. For example, there can be cited a case, as one example, in which the initial shape of the contour line OL1 is designed to have the same shape as that of the first circumscribed rectangle RC1 or the initial shape of the contour line OL2 is designed to have the same shape as that of the second circumscribed rectangle RC2.

Also, in the aforementioned exemplified embodiments, there is explained the magnetic core (magnetic core 10) including two flange portions (first flange portion 12 and second flange portion 13) in which those two portions have shapes & sizes identical to each other, but it is possible for the present invention to be applied also with respect to a magnetic core including two flange portions which have shapes different from each other or a magnetic core including a flange portion only on one single axial-end side of the winding core portion.

Also, in the aforementioned exemplified embodiment, the shapes of the contour lines OL1, OL2 are designed to be irregular convex polygons, but it is also possible for the shapes of the contour lines OL1, OL2 to use various irregular convex shapes, for example, convex shapes which resemble ellipses or the like if they do not depart from the gist of the present invention.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A design method of a magnetic core which includes a winding core portion and a flange portion provided on at least one of the axial end sides of the winding core portion, comprising the steps of:

setting, on the same design-plane, a first circumscribed rectangle circumscribed to contour line of a first cross section of the flange portion, which becomes perpendicular with respect to an axis line of the winding core portion and a second circumscribed rectangle circumscribed to contour line of a second cross-section of the winding core portion which becomes perpendicular with respect to the axis line of the winding core portion;

setting, on the design-plane, an initial shape of the first cross-section and an initial shape of the second cross-section;

setting, on the design-plane, a I corner cutting line and a II corner cutting line which respectively and obliquely remove a first corner portion and a second corner portion, of the first circumscribed rectangle, which are positioned on a first one diagonal line of the first circumscribed rectangle, to be portions of a first contour line;

reducing, on the design-plane, the shape of the second cross-section at a first corner portion and the second corner portion, of the second circumscribed rectangle, which correspond to the first corner portion and the second corner portion of the first circumscribed rectangle such that a predetermined width of a winding frame is to be secured between the I corner cutting line and the II corner cutting line and the contour line of the winding core portion; and increasing, on the design-plane, the shape of the second cross-section at a third corner portion and a forth corner portion of the second circumscribed rectangle as much as the reduced degree of the shape of the cross-section at the first corner portion and the second corner portion.

* * * * *